US007672834B2

(12) United States Patent
Smaragdis

(10) Patent No.: US 7,672,834 B2
(45) Date of Patent: Mar. 2, 2010

(54) METHOD AND SYSTEM FOR DETECTING AND TEMPORALLY RELATING COMPONENTS IN NON-STATIONARY SIGNALS

(75) Inventor: Paris Smaragdis, Brookline, MA (US)

(73) Assignee: Mitsubishi Electric Research Laboratories, Inc., Cambridge, MA (US)

( * ) Notice: Subject to any disclaimer, the term of this patent is extended or adjusted under 35 U.S.C. 154(b) by 1986 days.

(21) Appl. No.: 10/626,456

(22) Filed: Jul. 23, 2003

(65) Prior Publication Data

US 2005/0021333 A1 Jan. 27, 2005

(51) Int. Cl.
*G10L 19/02* (2006.01)

(52) U.S. Cl. ..... 704/204; 704/203

(58) Field of Classification Search ..... 704/256, 704/500, 4, 201, 203; 708/514, 520
See application file for complete search history.

(56) References Cited

U.S. PATENT DOCUMENTS

| | | | | | |
|---|---|---|---|---|---|
| 5,751,899 | A * | 5/1998 | Large et al. | ..... | 704/207 |
| 5,966,691 | A * | 10/1999 | Kibre et al. | ..... | 704/260 |
| 6,104,992 | A * | 8/2000 | Gao et al. | ..... | 704/220 |
| 6,151,414 | A * | 11/2000 | Lee et al. | ..... | 382/253 |
| 6,321,200 | B1 | 11/2001 | Casey | ..... | 704/500 |
| 6,389,377 | B1 * | 5/2002 | Pineda et al. | ..... | 703/4 |
| 6,401,064 | B1 * | 6/2002 | Saul | ..... | 704/240 |
| 6,434,515 | B1 * | 8/2002 | Qian | ..... | 702/190 |
| 6,570,078 | B2 * | 5/2003 | Ludwig | ..... | 84/600 |
| 6,691,073 | B1 * | 2/2004 | Erten et al. | ..... | 702/190 |
| 6,711,528 | B2 * | 3/2004 | Dishman et al. | ..... | 702/189 |
| 6,745,155 | B1 * | 6/2004 | Andringa et al. | ..... | 702/189 |
| 6,847,737 | B1 * | 1/2005 | Kouri et al. | ..... | 382/260 |
| 6,931,362 | B2 * | 8/2005 | Beadle et al. | ..... | 702/190 |
| 6,961,473 | B1 * | 11/2005 | Mitchell et al. | ..... | 382/240 |
| 7,236,640 | B2 * | 6/2007 | Subramaniam et al. | ..... | 382/253 |
| 7,415,392 | B2 * | 8/2008 | Smaragdis | ..... | 702/190 |
| 7,536,431 | B2 * | 5/2009 | Goren et al. | ..... | 708/831 |
| 2001/0027382 | A1 * | 10/2001 | Jarman et al. | ..... | 702/179 |

OTHER PUBLICATIONS

Lee et al., "Learning the parts of objects by non-negative matrix factorization," Nature, vol. 401, pp. 788-791, 1999.

* cited by examiner

*Primary Examiner*—Michael N Opsasnick
(74) *Attorney, Agent, or Firm*—Gene Vinokur; Dirk Brinkman

(57) ABSTRACT

A method detects components of a non-stationary signal. The non-stationary signal is acquired and a non-negative matrix of the non-stationary signal is constructed. The matrix includes columns representing features of the non-stationary signal at different instances in time. The non-negative matrix is factored into characteristic profiles and temporal profiles.

15 Claims, 10 Drawing Sheets

METHOD AND SYSTEM FOR DETECTING AND TEMPORALLY RELATING COMPONENTS IN NON-STATIONARY SIGNALS

FIELD OF THE INVENTION

The invention relates generally to the field of signal processing and in particular to detecting and relating components of signals.

BACKGROUND OF THE INVENTION

Detecting components of signals is a fundamental objective of signal processing. Detected components of acoustic signals can be used for myriad purposes, including speech detection and recognition, background noise subtraction, and music transcription, to name a few. Most prior art acoustic signal representation methods have focused on human speech and music where detected component is usually a phoneme or a musical note. Many computer vision applications detect components of videos. Detected components can be used for object detection, recognition and tracking.

There are two major types of approaches to detecting components in signals, namely knowledge based, and unsupervised or data driven. Knowledge-based approaches can be rule-based. Rule-based approaches require a set of human-determined rules by which decisions are made. Rule-based component detection is therefore subjective, and decisions on occurrences of components are not based on actual data to be analyzed. Knowledge based system have serious disadvantages. First, the rules need to be coded manually. Therefore, the system is only as good as the 'expert'. Second, the interpretation of inferences between the rules often behaves erratically, particularly when there is no applicable rule for some specific situation, or when the rules are 'fuzzy'. This can cause the system to operate in an unintended and erratic manner.

The other major types of approach to detecting components in signals are data driven. In data driven approaches, the components are detected directly from the signal itself, without any a priori understanding of what the signal is, or could be in the future. Since input data is often very complex, various types of transformations and decompositions are known to simplify the data for the purpose of analysis.

U.S. Pat. No. 6,321,200, "Method for extracting features from a mixture of signals," issued to Casey on Nov. 20, 2001 describes a system that extracts low level features from an acoustic signal that has been band-pass filtered and simplified by a singular value decomposition. However, some features cannot be detected after dimensionality reduction because the matrix elements lead to cancellations, and obfuscate the results.

Non-negative matrix factorization (NMF) is an alternative technique for dimensionality reduction, see, Lee, et al, "Learning the parts of objects by non-negative matrix factorization," Nature, Volume 401, pp. 788-791, 1999.

There, non-negativity constraints are enforced during matrix construction in order to determine parts of faces from a single image. Furthermore, that system is restricted within the spatial confines of a single image, that is, the signal is stationary.

SUMMARY OF THE INVENTION

The invention provides a method for detecting components of a non-stationary signal. The non-stationary signal is acquired and a non-negative matrix of the non-stationary signal is constructed. The matrix includes columns representing features of the non-stationary signal at different instances in time. The non-negative matrix is factored into characteristic profiles and temporal profiles.

DETAILED DESCRIPTION OF THE PREFERRED EMBODIMENT

Introduction

Figure 1:
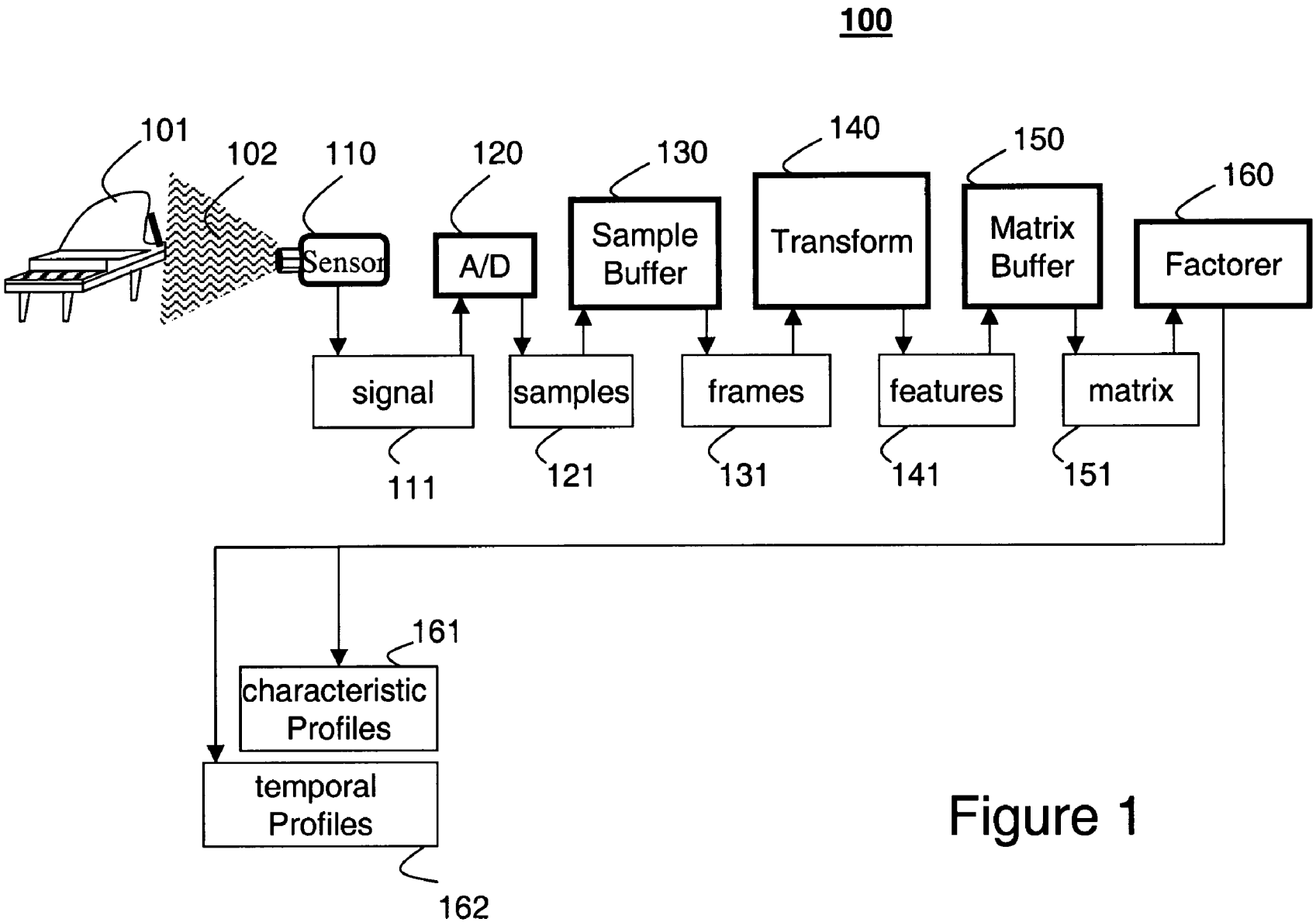
FIG. 1 is a block diagram of a system for detecting non-stationary signal components according to the invention.
Figure 2:
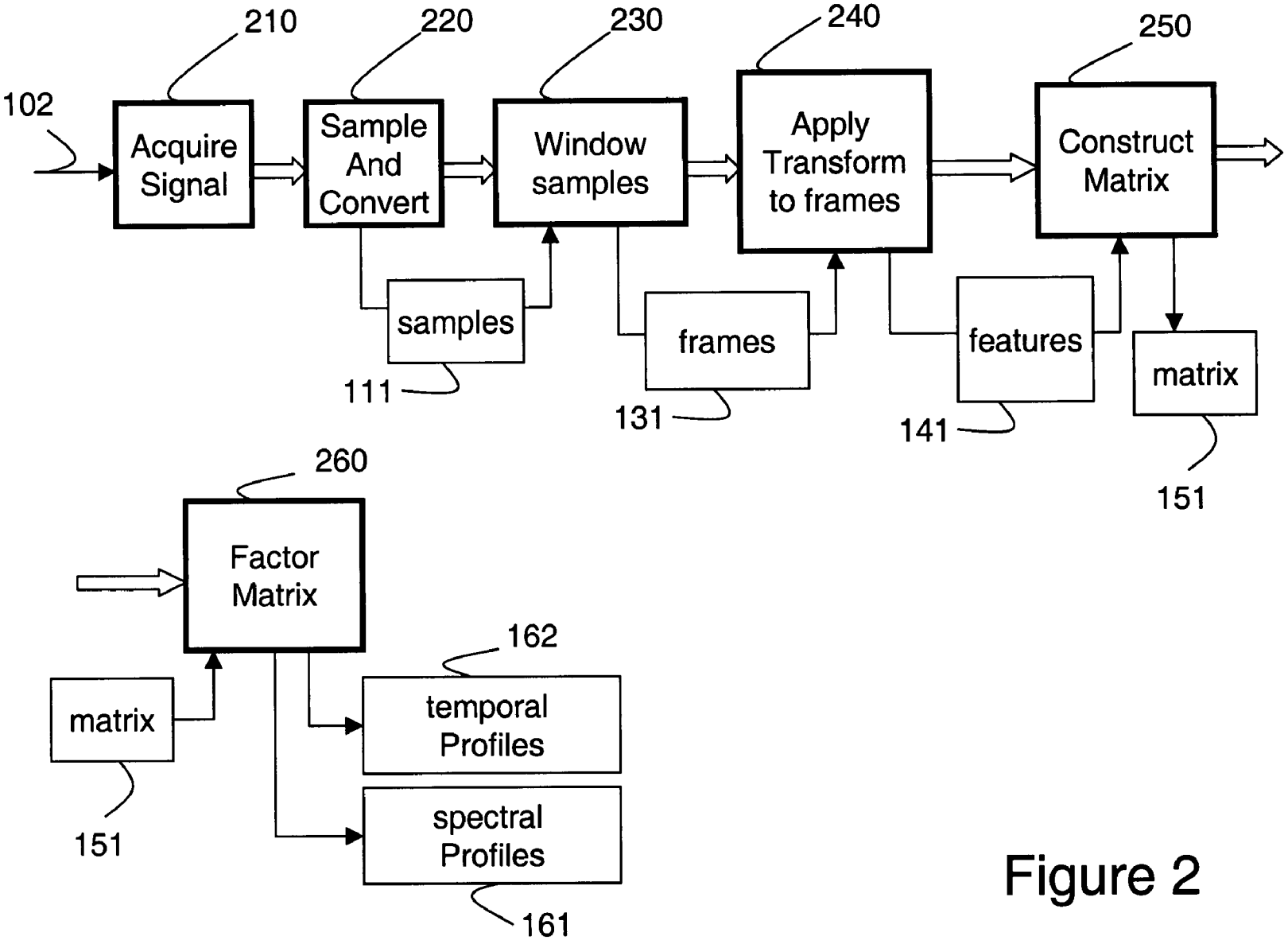
FIG. 2 is a flow diagram of a method for detecting non-stationary signal components according to the invention.

As shown in FIGS. 1 and 2, the invention provides a system 100 and method 200 for detecting components of non-stationary signals, and determining a temporal relationship among the components.

System Structure

The system 100 includes a sensor 110, e.g., microphone, an analog-to-digital (A/D) converter 120, a sample buffer 130, a transform 140, a matrix buffer 150, and a factorer 160, serially connected to each other. An acquired non-stationary signal 111 is input to the A/D converter 120, which outputs samples 121 to the sample buffer 130. The samples are windowed to produce frames 131 for the transform 140, which outputs features 141, e.g., magnitude spectra, to the matrix buffer 150. A non-negative matrix 151 is factored 160 to produce characteristic profiles 161 and temporal profiles 162, which are also non-negative matrices.

Method Operation

An acoustic signal 102 is generated by a piano 101. The acoustic signal is acquired 210, e.g., by the microphone 110. The acquired signal 111 is sampled and converted 220 and digitized samples 121 are windowed 230. A transform 140 is applied 240 to each frame 131 to produce the features 141. The features 141 are used to construct 250 a non-negative matrix 151. The matrix 151 is factored 260 into the characteristic profiles 161 and the temporal profiles 162 of the signal 102.

Constructing the Non-Negative Matrix

An example of the time-varying signal 102 can be expressed by $s(t)=g(\alpha t)\sin(\gamma t)+g(\beta t)\sin(\delta t)$, where $g(\bullet)$ is a gate function with a period of $2\pi$ and $\alpha$, $\beta$, $\gamma$, $\delta$ are arbitrary scalars with $\alpha$ and $\beta$ at least an order of magnitude smaller than γ and δ. The features 141 of the frames x(t) 131, having a length size L, are determined by a transform x(t)=|DFT([s(t) . . . s(t+L)])|140.

The non-negative matrix $F \in R^{M \times N}$ 151 is constructed 250 by arranging all the features 141 as N columns of the matrix 151 ordered temporally with M rows, where M is the total number of histogram bins into which the magnitude spectra features are accumulated, such that M=(L/2+1).

Figure 3:
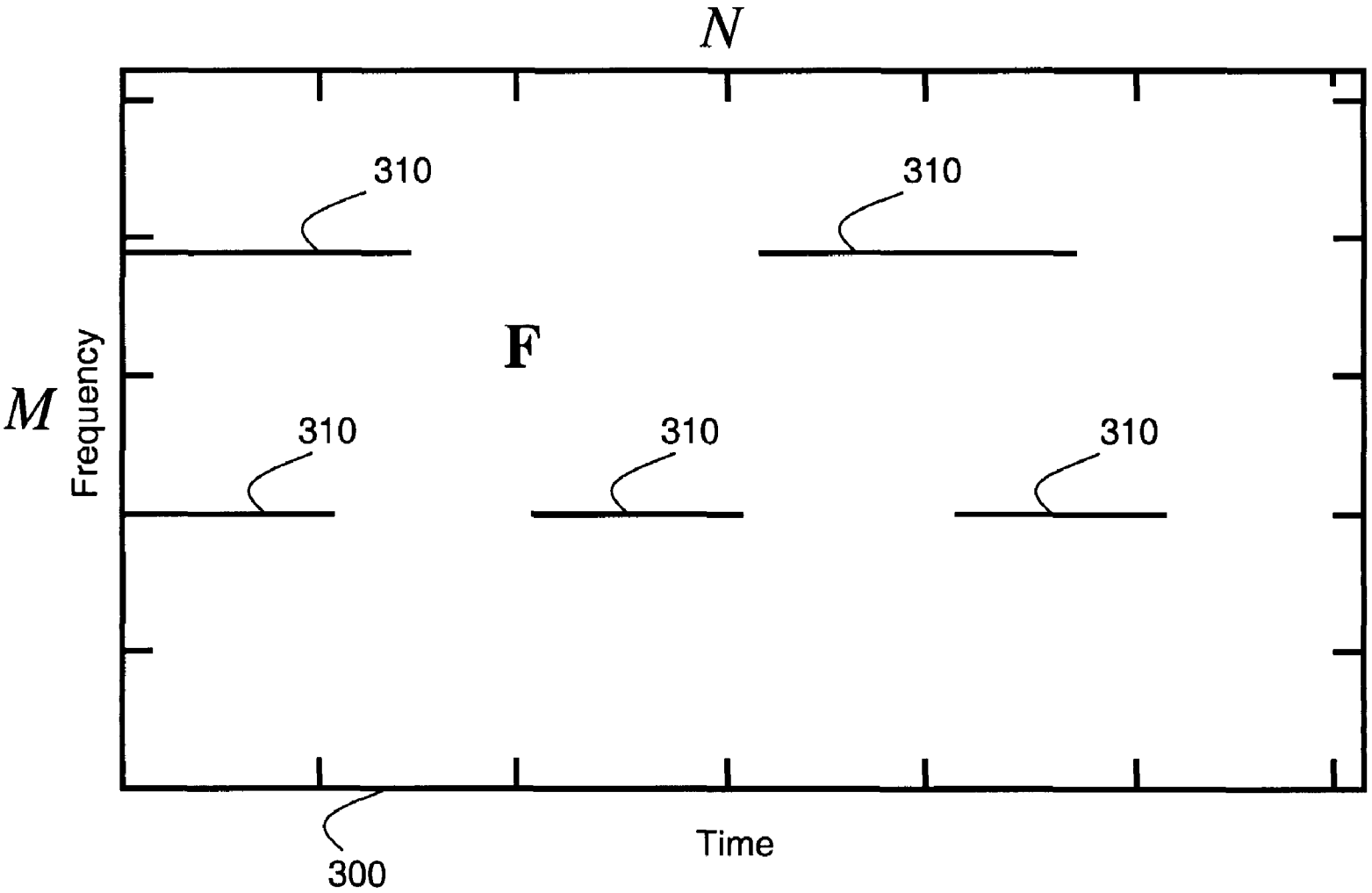
FIG. 3 is a spectrogram to be represented as a non-negative matrix.

FIG. 3 shows a binned spectrogram to be represented as the non-negative matrix 151 F of the signal s(t). This example has little energy except for a few frequency bins 310. The bins display a regular pattern.

Non-Negative Matrix Factorization

Figure 4B:
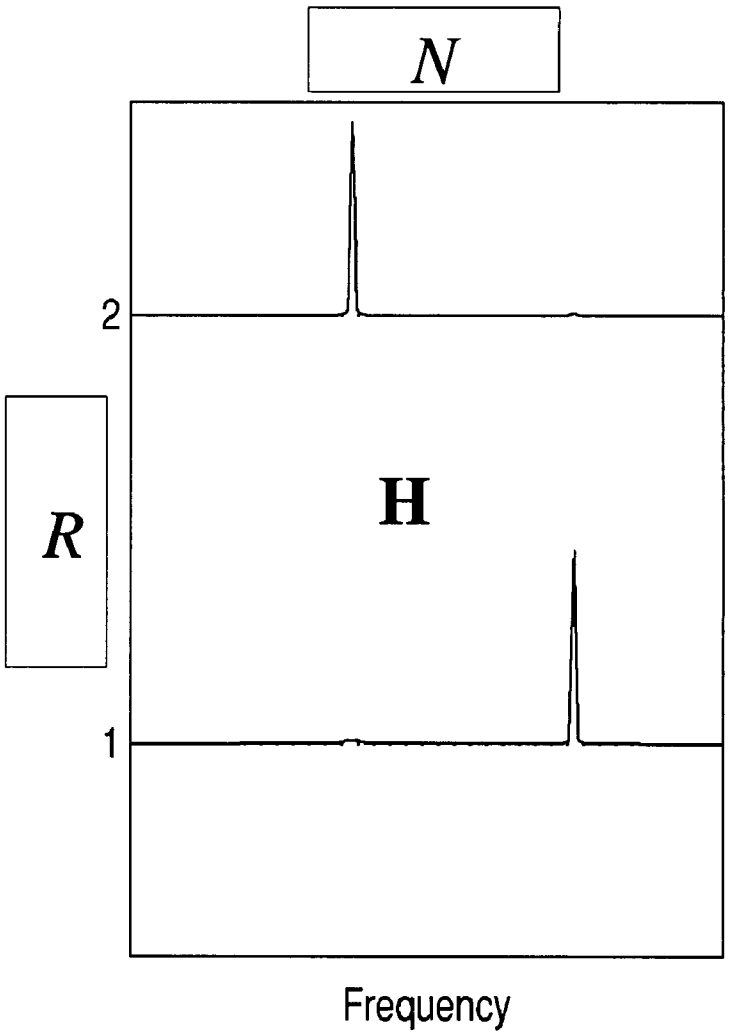
FIG. 4B is a diagram of characteristic profiles of the spectrogram of FIG. 3.
Figure 4A:
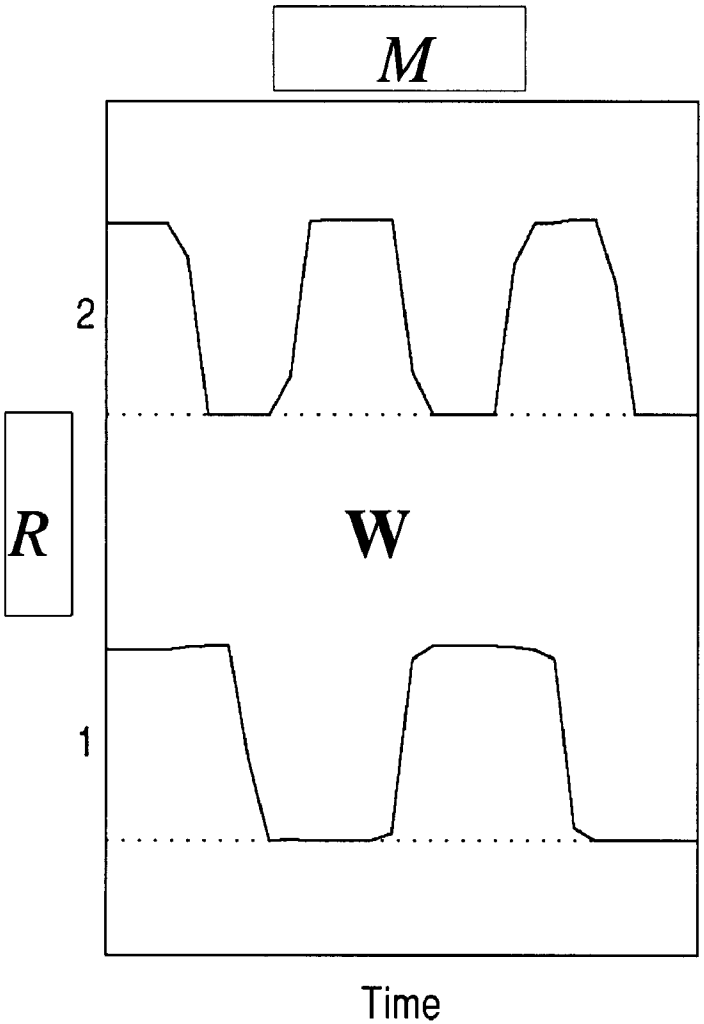
FIG. 4A is a diagram of temporal profiles of the spectrogram of FIG. 3.

As shown in FIGS. 4A-4B, the non-negative matrix $F \in R^{M \times N}$ is factored into two non-negative matrices $W \in R^{M \times R}$ (161) and $H \in R^{R \times N}$ (162), where R≦M, such that an error in a non-negative matrix reconstructed from the factors is minimized.

The parameter R is the desired number of components to be detected. If the actual number of components in the signal is known, parameter R is set to that known number and the error of reconstruction is minimized by minimizing a cost function $C=\|F-W \cdot H\|_F$ where $\|\bullet\|_F$ is the Frobenius norm. Alternatively, if R is set to an estimate of the number of components, then the cost function can be minimized by $$D = \left\| F \otimes \ln\left(\frac{F}{W \cdot H}\right) - F + W \cdot H \right\|_F,$$

where ⊗ is a Hadamard product. Both C and D equal zero if F=W·H.

FIGS. 4B and 4A show respectively the spectral profiles 161 and the characteristic profiles 162 produced by the NMF on the matrix 151. In this case, the characteristic profiles of the components relate to frequency features. It is clear that component 1 occurs twice, and component 2 occurs thrice, compare with FIG. 3.

Results

Figure 5:
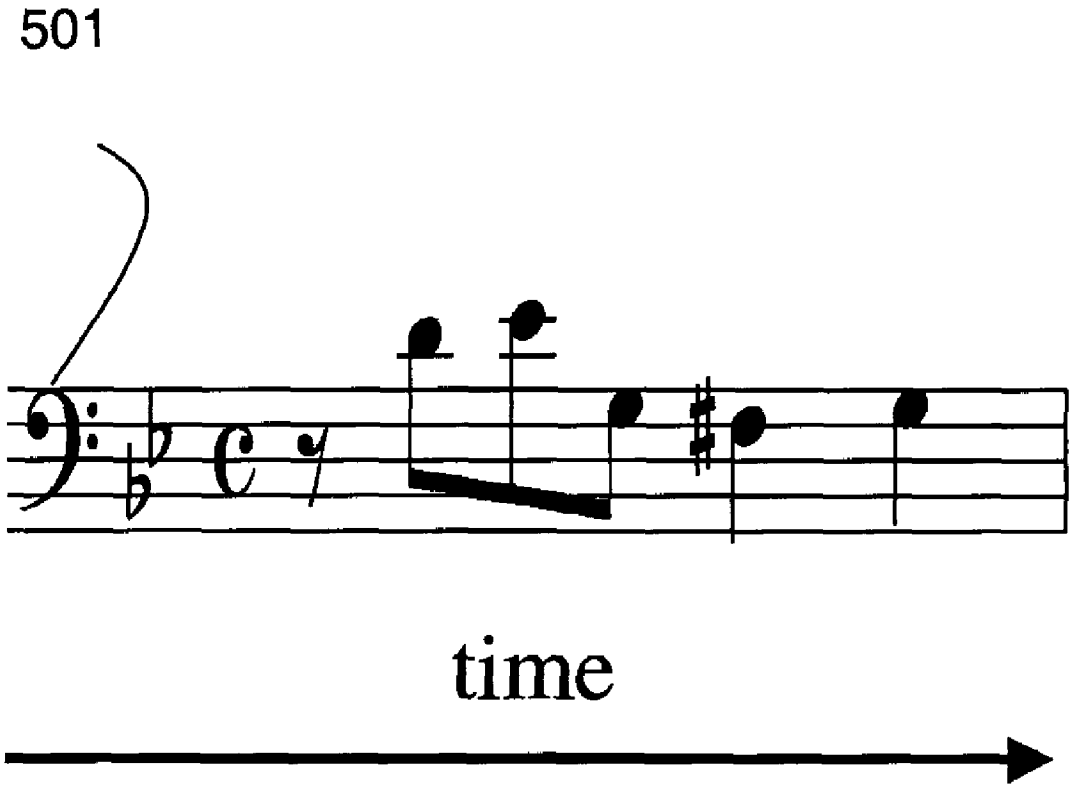
FIG. 5 is a bar of music with a temporal sequence of notes.

The system and method according to the invention was applied to a piano recording of Bach's fugue XVI in G minor, see Jarrett, "J. S. Bach, Das Wohltemperierte Klavier, Buch I", *ECM Records*, CD 2, Track 8, 1988. FIG. 5 shows one bar 501 of four distinct notes, with one note repeated twice. The recording was sampled at a rate of 44,100 kHz and converted to a monophonic signal by averaging the left and right channels of the stereophonic signal. The samples were windowed using a Hanning window. A 4096-point discrete Fourier transform was applied to each frame to generate the columns of the non-negative matrix. The first matrix was factored using the first cost function for R=4.

Figure 6:
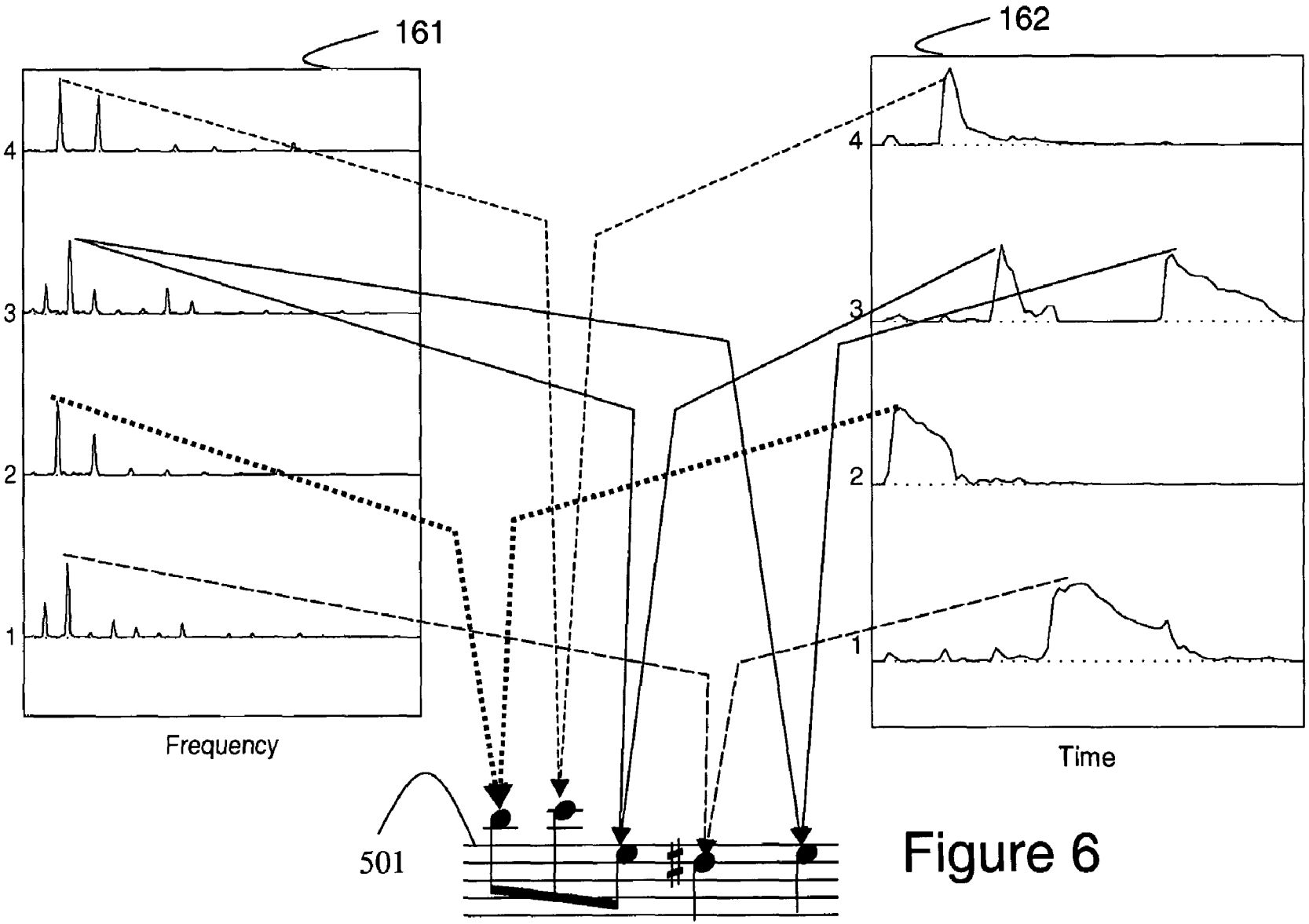
FIG. 6 is a block diagram correlating the profiles of FIGS. 4A-4B with the bar of music of FIG. 5.

FIG. 6 shows a correlation between the profiles and the bar of notes.

Figure 7B:
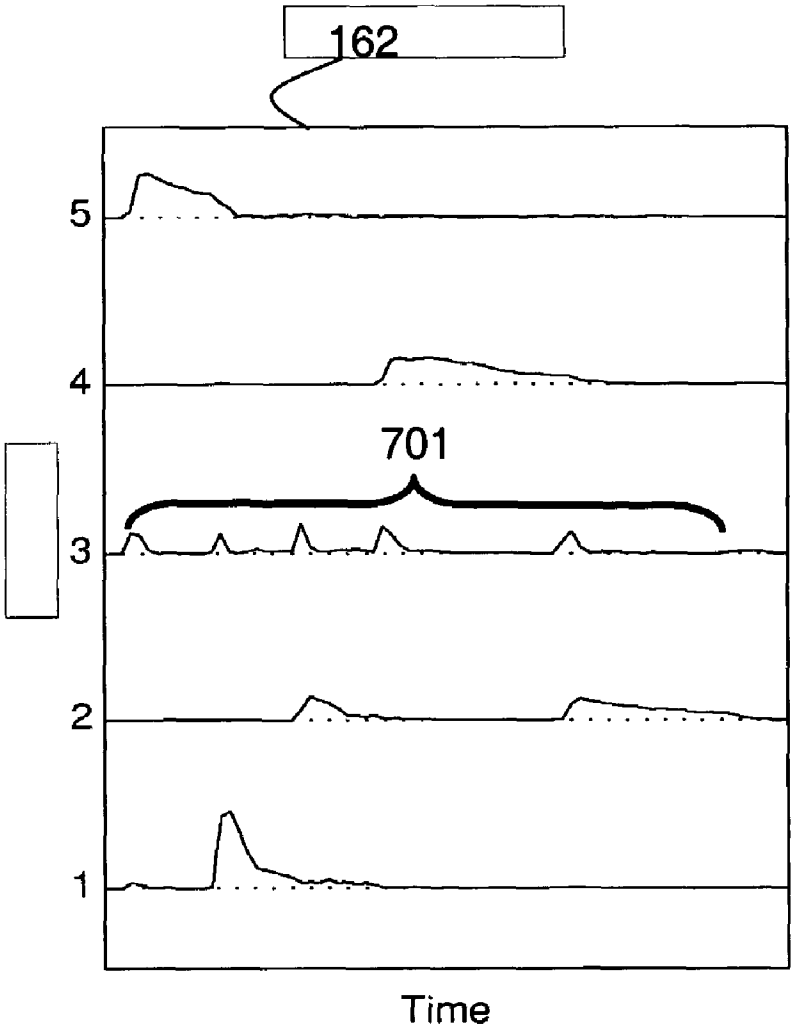
FIG. 7B is a characteristic profile.
Figure 7A:
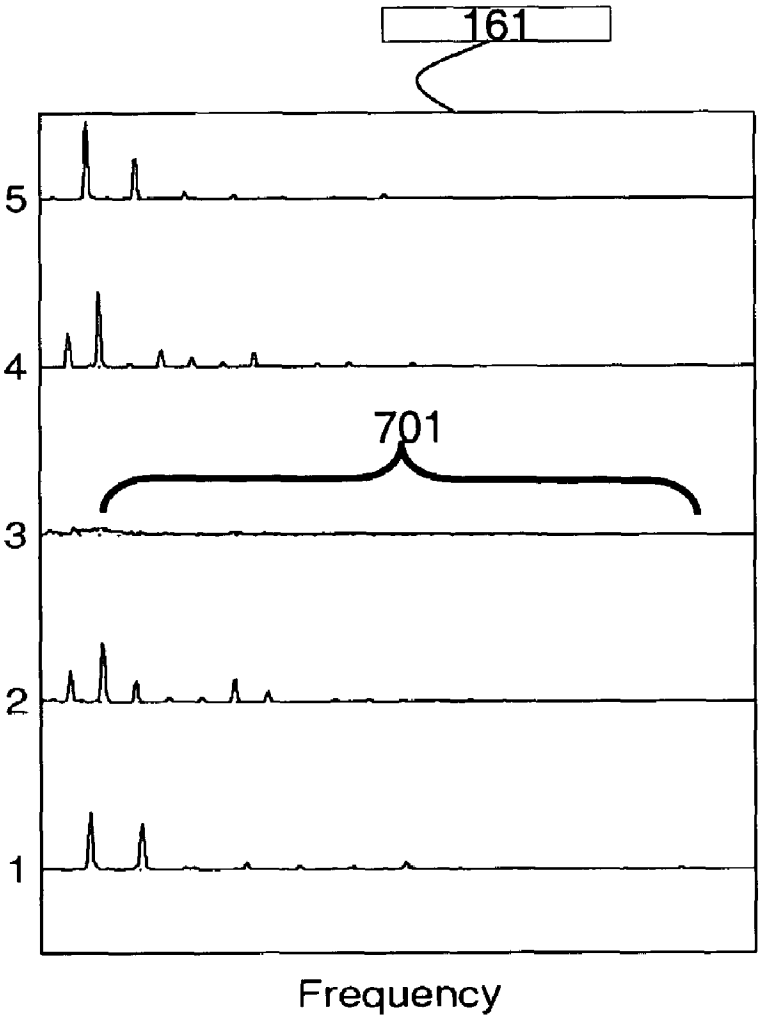
FIG. 7A is a temporal profile.

FIG. 7 show profiles produced by the factorization when the parameter R is 5, and the second cost function is used. The extra temporal profiles 701 can be identified by their low energy wideband spectrum. These profiles do not correspond to any components, and can be ignored.

Constructing a Non-Negative Matrix for Analysis of Video

The invention is not limited to 1D linear acoustic signal. Components can also be detected in non-stationary signals with higher dimensions, for example 2D. In this case, the piano 101 remains the same. The signal 102 is now visual, and the sensor 110 is a camera that converts the visual signal to pixels, which are sampled, over time, into frames 131, having an area size (X, Y). The frames can be transformed 140 in a number of ways, for example by rasterization, FFT, DCT, DFT, filtering, and so forth depending on the desired features to characterize for detection and correlation, e.g., intensity, color, texture, and motion.

Figure 8:
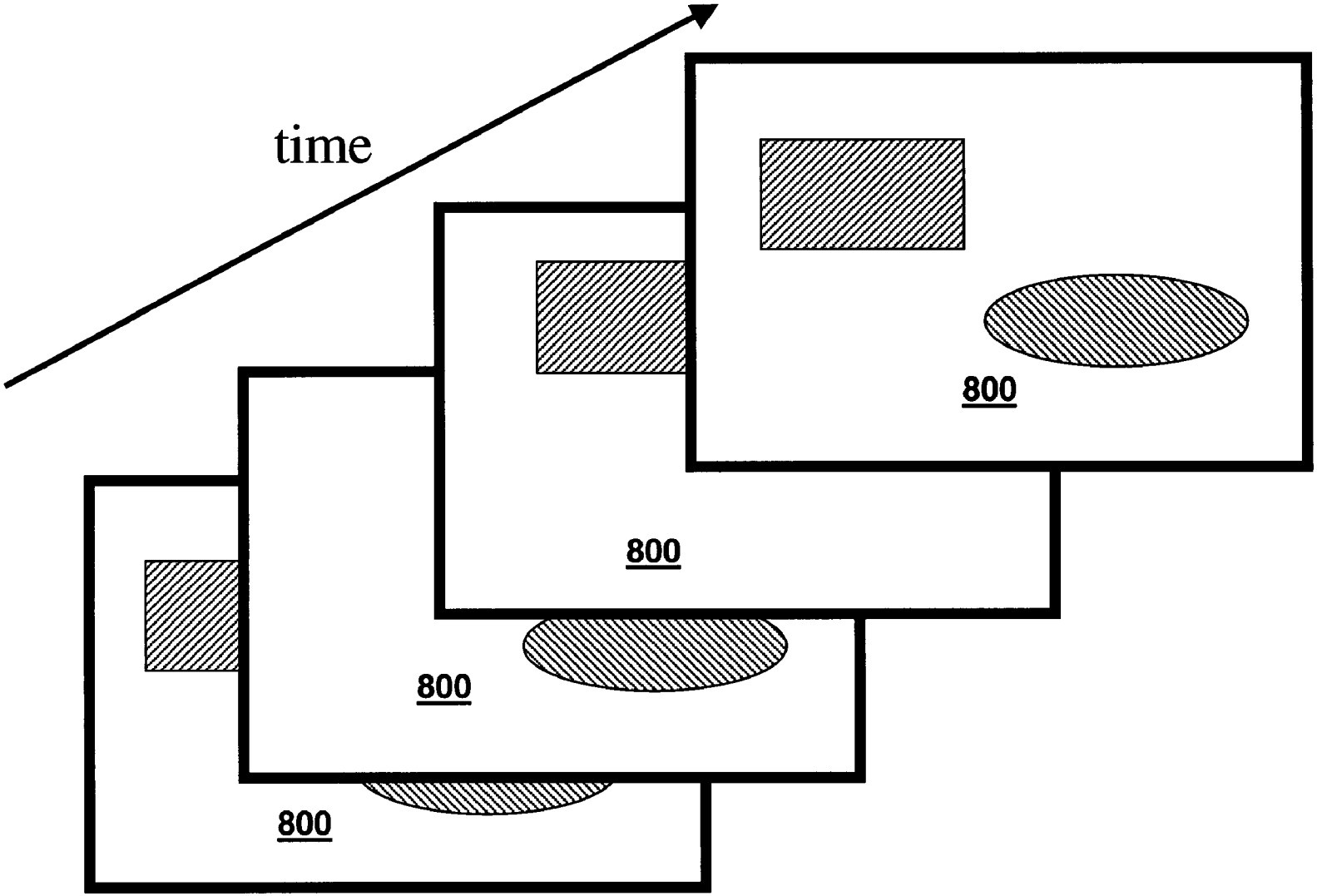
FIG. 8 is a block diagram of a video with a temporal sequence of frames.

FIG. 8 shows 2D frames 800 of a video. This action video has two simple components (rectangle and oval), each blinking on and off. In this example, the M pixels in each of the N frame are rasterized to construct the columns of the non-negative matrix 151.

Figure 9B:
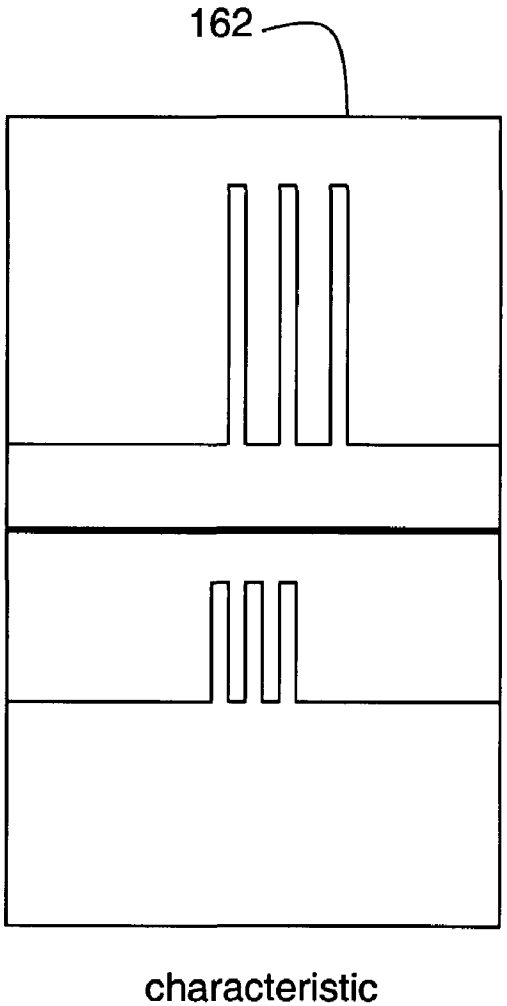
FIG. 9B is a characteristic profile of the video of FIG. 8.
Figure 9A:
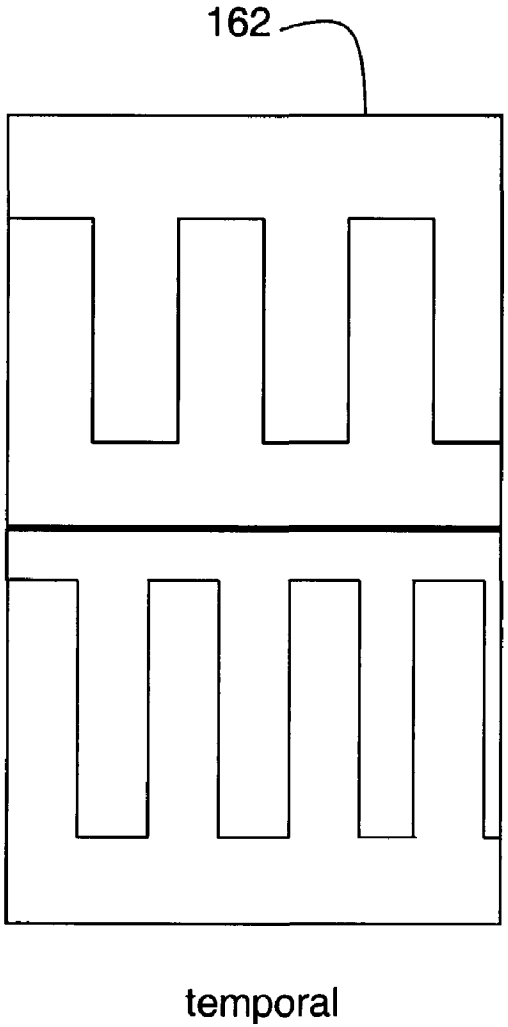
FIG. 9A is a temporal profile of the video of FIG. 8.

FIGS. 9A-9B show the characteristic profiles 161 and the temporal profiles 162 of the components of the video, respectively. In this case, the characteristic profiles of the components relate to spatial features of the frames.

As a further example, to illustrate the generality of the invention, the non-stationary signal can be in 3D. Again, the piano remains the same, but now one peers inside. The sensor is a scanner, and the frames become volumes. Transformations are applied, and profiles 161-162 can be correlated.

Figure 10:
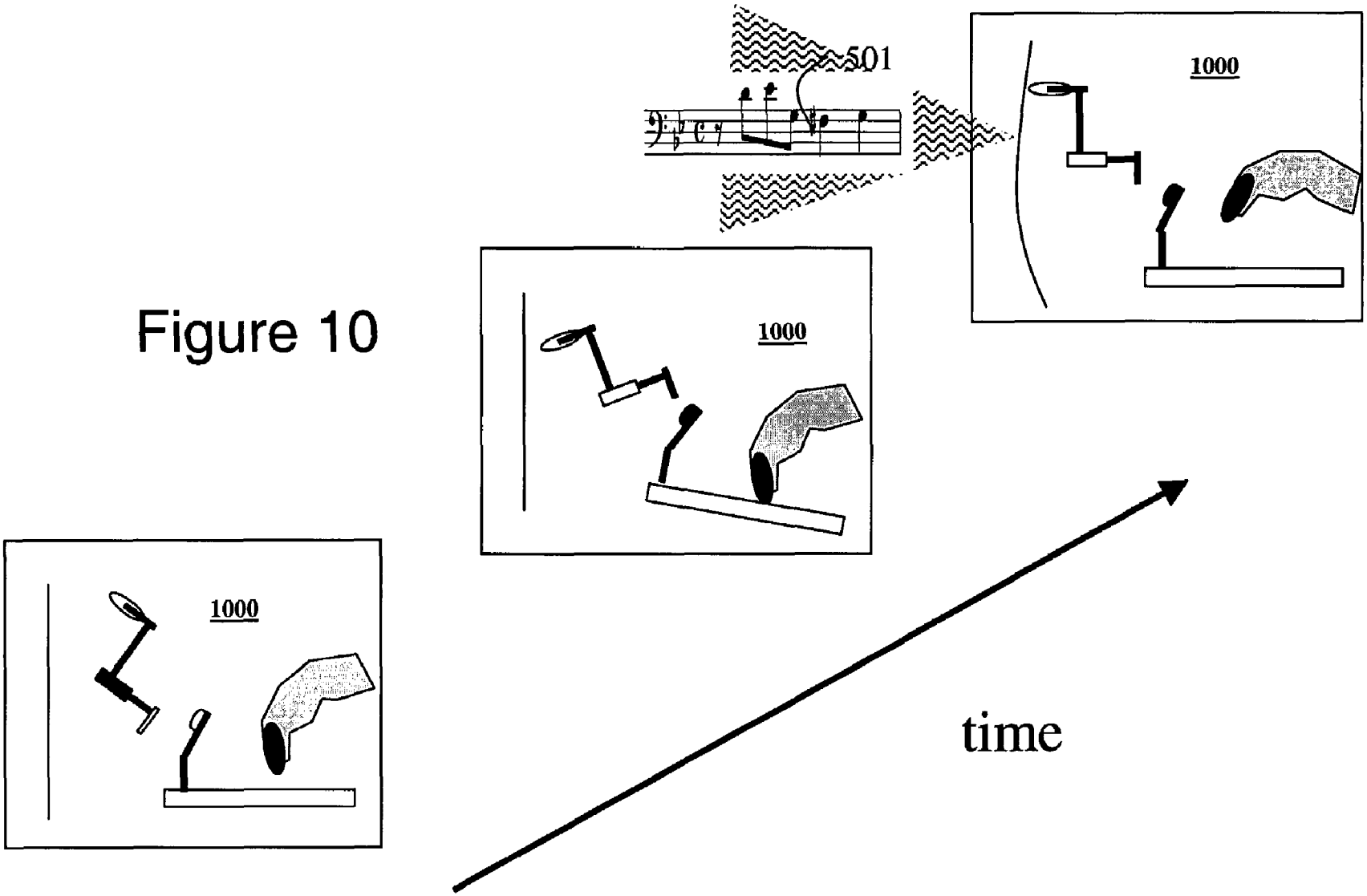
FIG. 10 is a schematic of a piano action.

It should be noted that the 1D acoustic signal, 2D visual signal, and 3D scanned profiles can also be correlated with each other when the acoustic, visual, and scanned signals are acquired simultaneously, since all of the signals are time aligned. Therefore, the motion of the piano player's fingers can, perhaps, be related to the keys as they are struck, rocking the rail, raising the sticker and whippen to push the jack heel and hammer, engaging the spoon and damper, until the action 1000 causes the strings to vibrate to produce the notes, see FIG. 10.

Although the invention has been described by way of examples of preferred embodiments, it is to be understood that various other adaptations and modifications may be made within the spirit and scope of the invention. Therefore, it is the object of the appended claims to cover all such variations and modifications as come within the true spirit and scope of the invention.

I claim:

1. A computer implemented method for detecting components of a non-stationary signal, comprising a computer system for performing steps of the method, comprising the steps of:

acquiring the non-stationary signal with a sensor;

constructing a non-negative matrix of the non-stationary signal in a matrix buffer of the computer system, the matrix including columns representing features of the non-stationary signal at different instances in time, in which the non-negative matrix has M temporally ordered columns where M is a total number of histogram bins into which the features are accumulated, such that M=(L/2+1), for a signal of length L; and producing characteristic profiles and temporal profiles of the non-stationary signal by factoring the non-negative matrices.

2. The method of claim 1 in which the non-stationary signal is an acoustic signal.

3. The method of claim 1 in which the non-stationary signal is a 2D visual signal.

4. The method of claim 1 in which the non-stationary signal is a 3D-scanned signal and frames of the signal represent volumes.

5. The method of claim 1, in which the non-negative matrix is $F \in R^{M \times N}$ and the non-negative matrix $F \in R^{M \times N}$ is factored into two non-negative matrices $W \in R^{M \times R}$ and $H \in R^{R \times N}$, where R≧M, such that an error in a non-negative matrix reconstructed from the factors is minimized.

6. The method of claim 1, in which the non-stationary signal includes an acoustic signal and a visual signal acquired simultaneously.

7. The method of claim 1, further comprising:

detecting components in the non-stationary signal according to the characteristic profiles and temporal profiles.

8. The method of claim 7, in which the non-stationary signal is music and the components are notes.

9. The method of claim 7, in which the non-stationary signal is visual and the components are spatial features in frames of the video.

10. The method of claim 1 in which the non-negative matrix is expressed as $R^{M\times N}$, the temporal profiles are expressed as $R^{M\times R}$ and the characteristic profiles are expressed as $R^{R\times N}$, where R≧M, where R is a number of components to be detected.

11. The method of claim 10 in which the number of components R is an estimate number of components.

12. The method of claim 10 in which the number of components R is known.

13. The method of claim 12, in which a cost function is $$C=\|F-W\cdot H\|_F,$$

where $\|\bullet\|_F$ is a Frobenius norm, and C is zero if F=W·H.

14. The method of claim 12, in which a cost function is minimized according to $$D=\left\|F\otimes\ln\left(\frac{F}{W\cdot H}\right)-F+W\cdot H\right\|_F,$$

where ⊗ is a Hadamard product, and D is zero if F=W·H.

15. A system for detecting components of a non-stationary signal, comprising:

a sensor;

an analog-to-digital converter;

a sample buffer;

a transform;

a matrix buffer; and a factorer serially connected to each other, in which an acquired non-stationary signal is input to the analog-to-digital converter to output samples to the sample buffer, in which the samples are windowed to produce frames for the transform, which outputs features to the matrix buffer as a non-negative matrix, which is factored to produce characteristic profiles and temporal profiles, in which the non-negative matrix has M temporally ordered columns where M is a total number of histogram bins into which the features are accumulated, such that M=(L/2+1), for a signal of length L.

* * * * *